US008550877B2

(12) United States Patent
Shibuya et al.

(10) Patent No.: US 8,550,877 B2
(45) Date of Patent: Oct. 8, 2013

(54) METHOD OF MANUFACTURING ANNULAR BODY

(75) Inventors: Hiroshi Shibuya, Kanagawa (JP); Yoshitake Ogura, Kanagawa (JP); Masato Saito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 404 days.

(21) Appl. No.: 13/022,205

(22) Filed: Feb. 7, 2011

(65) Prior Publication Data

US 2012/0077420 A1 Mar. 29, 2012

(30) Foreign Application Priority Data

Sep. 24, 2010 (JP) ..... 2010-214236

(51) Int. Cl.
*B24B 1/00* (2006.01)

(52) U.S. Cl.
USPC ..... 451/39; 451/37; 451/38; 451/60; 451/446; 451/40

(58) Field of Classification Search
USPC ..... 451/37, 38, 39, 40, 60, 446
See application file for complete search history.

(56) References Cited

U.S. PATENT DOCUMENTS

| | | | | |
|---|---|---|---|---|
| 1,639,171 | A * | 8/1927 | Fischer | 101/395 |
| 5,024,711 | A * | 6/1991 | Gasser et al. | 156/153 |
| 5,332,643 | A * | 7/1994 | Harada et al. | 430/127 |
| 5,573,445 | A * | 11/1996 | Rasmussen et al. | 451/39 |
| 5,586,927 | A * | 12/1996 | Herbert | 451/88 |
| 5,791,970 | A * | 8/1998 | Yueh | 451/8 |
| 5,827,114 | A * | 10/1998 | Yam et al. | 451/75 |
| 6,175,713 | B1 | 1/2001 | Uehara et al. | |
| 6,195,525 | B1 | 2/2001 | Maeyama | |
| 6,368,195 | B1 * | 4/2002 | Oshio et al. | 451/88 |
| 6,910,937 | B2 * | 6/2005 | Yoshikawa et al. | 445/24 |
| 7,040,962 | B2 * | 5/2006 | Makino et al. | 451/39 |
| 7,056,193 | B2 * | 6/2006 | Yoshikawa et al. | 451/36 |
| 2001/0051682 | A1 | 12/2001 | Tamura et al. | |
| 2002/0187267 | A1 | 12/2002 | Tamura et al. | |
| 2004/0197478 | A1 | 10/2004 | Takagi | |
| 2005/0170755 | A1 * | 8/2005 | Yoshikawa et al. | 451/38 |

(Continued)

FOREIGN PATENT DOCUMENTS

| | | |
|---|---|---|
| JP | A-05-062411 | 3/1993 |
| JP | A-08-267361 | 10/1996 |

(Continued)

OTHER PUBLICATIONS

Japanese Office Action in Japanese Patent Application No. 2010-214236; dated Dec. 21, 2010 (with English-Language translation).

*Primary Examiner* — George Nguyen
(74) *Attorney, Agent, or Firm* — Oliff & Berridge, PLC

(57) ABSTRACT

A method includes: charging a polishing material into a polishing apparatus that polishes a surface of a cylindrical film including a resin; alternately and repeatedly performing a surface-roughening operation of causing the polishing material to collide with the surface of the cylindrical film, thereby roughening the surface, and a cylindrical film replacing operation of replacing the cylindrical film on which roughening of the surface has been completed with another cylindrical film on which roughening of the surface has not been completed; replacing the polishing material by partially discharging the polishing material, and charging a new polishing material so that the percentage of the new polishing material with respect to the total amount of the polishing material after the new polishing material is charged becomes 30% by weight or more; and alternately and repeatedly performing the surface-roughening operation and the cylindrical film replacing operation again.

7 Claims, 9 Drawing Sheets

(56) References Cited

U.S. PATENT DOCUMENTS

| | | | | |
|---|---|---|---|---|
| 2008/0156212 | A1* | 7/2008 | Yamada et al. | 101/375 |
| 2010/0151204 | A1* | 6/2010 | Lee et al. | 428/156 |

FOREIGN PATENT DOCUMENTS

| | | |
|---|---|---|
| JP | A-11-320753 | 11/1999 |
| JP | A-11-352804 | 12/1999 |
| JP | A-2000-188177 | 7/2000 |
| JP | A-2000-239422 | 9/2000 |
| JP | A-2000-254863 | 9/2000 |
| JP | A-2002-091027 | 3/2002 |
| JP | A-2003-105551 | 4/2003 |
| JP | A-2006-043793 | 2/2006 |
| JP | A-2010-077467 | 4/2010 |

* cited by examiner

METHOD OF MANUFACTURING ANNULAR BODY

CROSS-REFERENCE TO RELATED APPLICATION

This application is based on and claims priority under 35 USC 119 from Japanese Patent Application No. 2010-214236 filed Sep. 24, 2010.

BACKGROUND

1. Technical Field

The present invention relates to a method of manufacturing an annular body.

2. Related Art

An electromagnetic induction heating fixing method requires a coil and a high-frequency power source in addition to a heating and fixing member having a heat-generation layer, and a pressure member. The coil is installed at a position which is inside or outside of the heating and fixing member and close to the heating and fixing member, and is electrically connected to the high-frequency power source. A high-frequency alternating current is made to flow through the coil by this high-frequency power source, and at this time, a magnetic flux is generated around the coil in a direction orthogonal to a surface around which the coil is wound according to the direction of the current. The magnetic flux crosses the heat-generation layer of the heating and fixing member installed in proximity to the coil, and an eddy current, which generates a magnetic field in a direction in which this magnetic flux is cancelled out, is generated in the heat-generation layer on the heating and fixing member. Since the heat-generation layer has a resistance value determined by the material and thickness thereof, the electrical energy from the generated eddy current is converted into heat energy. A fixing device using the heat generated at this time is an electromagnetic induction heating fixing device.

As a fixing belt for electromagnetic induction heating fixing, there is a fixing belt in which a metal layer is laminated on a polyimide resin layer from the inner peripheral surface side to the outer peripheral surface side. A method of forming this metal layer through electroless plating has been tried.

SUMMARY

According to an aspect of the invention, there is provided a method of manufacturing an annular body, including:

(A) charging a polishing material into a polishing apparatus that polishes a surface of a cylindrical film including a resin;

(B) alternately and repeatedly performing a surface-roughening operation of causing the polishing material to collide with the surface of the cylindrical film, thereby roughening the surface, and a cylindrical film replacing operation of replacing the cylindrical film on which roughening of the surface has been completed with another cylindrical film on which roughening of the surface has not been completed;

(C) replacing the polishing material by discharging a portion of the polishing material charged into the polishing apparatus after the (B) alternately and repeatedly performing the surface-roughening operation and the cylindrical film replacing operation, and charging a new polishing material so that the percentage of the new polishing material with respect to the total amount of the polishing material after the new polishing material is charged becomes 30% by weight or more; and (D) alternately and repeatedly performing the surface-roughening operation and the cylindrical film replacing operation again after the (C) replacing the polishing material.

BRIEF DESCRIPTION OF THE DRAWINGS

Exemplary embodiments of the present invention will be described in detail based on the following figures, wherein:

FIG. 7A is a view seen from the side, and FIG. 7B is a view seen from the front;

DETAILED DESCRIPTION

Exemplary embodiments of the invention will now be described below in detail.

A method of manufacturing an annular body according to the exemplary embodiment includes the following steps.

Polishing Material Charging Step

A polishing material is charged into a polishing apparatus which polishes a surface of a cylindrical film including a resin.

First Surface-Roughening Repeating Step

A surface-roughening operation of causing the polishing material to collide with the surface of the cylindrical film, thereby roughening the surface, and a cylindrical film replacing operation of replacing the cylindrical film on which roughening of the surface has been completed with another cylindrical film on which roughening of the surface has not been completed are alternately and repeatedly performed.

Polishing Material Replacing Step

The polishing material is replaced by discharging a portion of the polishing material charged into the polishing apparatus after the first surface-roughening repeating step, and charging a new polishing material so that the percentage of the new polishing material with respect to the total amount of the polishing material after the new polishing material is charged becomes 30% by weight or more (or about 30% by weight or more).

Second Surface-Roughening Repeating Step.

The surface-roughening operation and the cylindrical film replacing operation are alternately and repeatedly performed again after the polishing material replacing step.

The polishing material is deteriorated by repeating the collision with the cylindrical film, and becomes gradually smaller. Particularly when a polishing material having an irregular shape is used, corners are removed and rounded, and approach a spherical form. In a case where surface roughening has been performed by such a deteriorated polishing material, a rough surface which has recesses 32 and protrusions 33 formed on the surface of a resin layer 31 and has acute edges 34 as shown in FIG. 1 is not obtained, but a rough surface having merely the recesses 32 and the protrusions 33 as shown in FIG. 2 is obtained.

Figure 1:
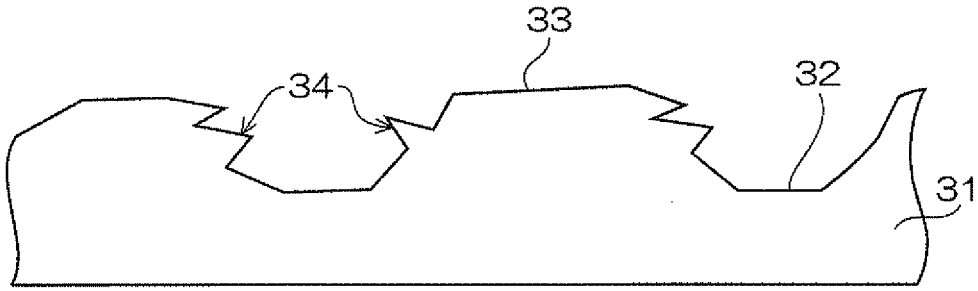
FIG. 1 is a schematic sectional view showing a surface-roughened state of a roughened surface of an annular body manufactured by a method of manufacturing an annular body according to an exemplary embodiment.
Figure 2:
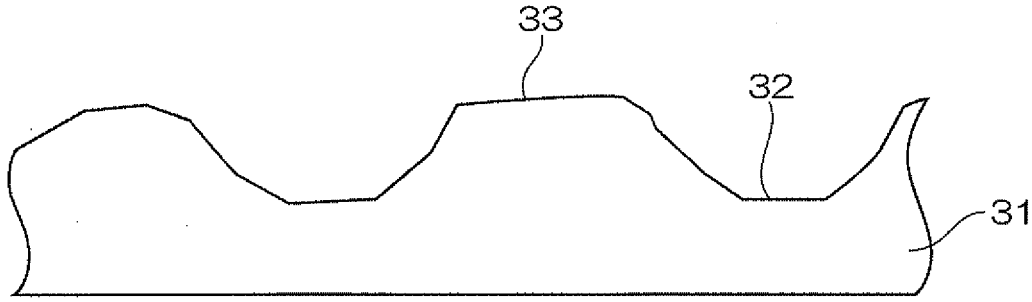
FIG. 2 is a schematic sectional view showing a surface-roughened state of a roughened surface of an annular body manufactured when a deteriorated polishing material is used in a conventional manufacturing method.
Figure 3A:
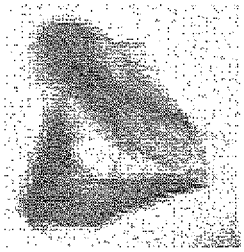
FIGS. 3A to 3D are images when a new polishing material before being used for surface roughening is photographed.
Figure 3B:
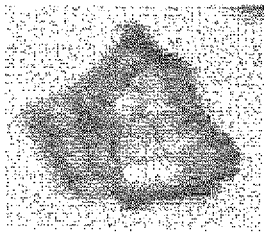
Figure 3C:
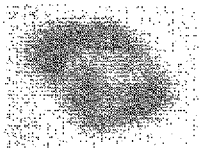
Figure 3D:
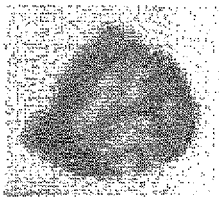
Figure 4A:
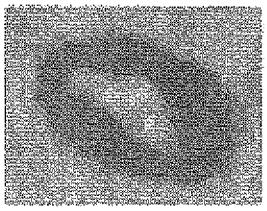
FIGS. 4A to 4D are images when a deteriorated polishing material after being used for surface roughening is photographed.
Figure 4B:
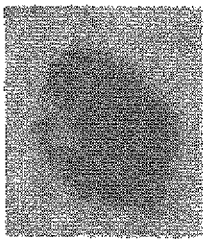
Figure 4C:
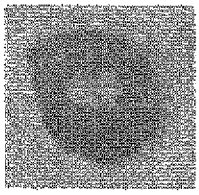
Figure 4D:
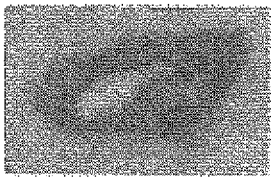

On the other hand, it has been found that the rough surface which has the recesses 32 and the protrusions 33 formed on the surface of the resin layer 31 and has the acute edges 34 as shown in FIG. 1 may be repeatedly obtained by discharging a portion of the deteriorated polishing material due to the repeated collision with the cylindrical film and charging a new polishing material so that the percentage of the new polishing material is in the above described range.

Thereby, adhesion is secured even if a metal layer is formed on the roughened surface of the cylindrical film by electroless plating or the like. In the electroless plating, a metal is deposited in the part in contact with a plating solution. Thus, even if there is a portion, in the resin layer 31, which is hidden from the surface by the acute edges 34 as shown in FIG. 1, a metal layer is deposited and formed even in an inner surface portion. Therefore, it is inferred that the metal layer which has entered the inner surface portion hidden from the surface exhibits an anchor effect (a biting effect), thereby securing adhesion.

By replacing the polishing material by performing the discharge of the polishing material and the charging of the new polishing material so that the percentage of the new polishing material becomes 30% by weight or more in the polishing material replacing step, manufacture of the cylindrical film (annular body) which has a desired surface state (for example, the ratio (surface area/projected area) of the surface area and projected area of the surface-roughened cylindrical film is 3.0 or more) may be repeated in larger quantities than before. As a result, even in a case where a metal layer is further formed on the surface of the surface-roughened annular body, an annular body from which the metal layer is hardly peeled off may be repeatedly manufactured in large quantities.

In a case where the percentage of the new polishing material is less than 30% by weight in the polishing material replacing step, a cylindrical film (annular body) having a desired surface state cannot be repeatedly manufactured in large quantities.

The percentage of the new polishing material may be 35% by weight or more, or 40% by weight or more.

Surface Area and Projected Area

In the cylindrical film after surface roughening (i.e., annular body manufactured in the exemplary embodiment), the ratio (surface area/projected area) of the surface area and projected area may be 3.0 or more, or 3.2 or more, or 3.4 or more.

The above ratio of the surface area and projected area is an index indicating the extent of an actual surface area with respect to the surface area in a case where the surface is flat. As irregularities are larger, the value of the ratio becomes larger, and the valued may be obtained by measurement with a laser microscope (for example, VK9500 made by KEYENCE CORPORATION).

Polishing Material Replacing Timing

As the timing when the polishing material replacing step is performed, in the first surface-roughening repeating step, repetition of the surface-roughening operation and the cylindrical film replacing operation may be ended before forming a cylindrical film in which the ratio (surface area/projected area) of the surface area and projected area of the roughened surface in the cylindrical film becomes less than 80% (or less than about 80%) with respect to the value of the ratio in the cylindrical film on which the surface roughening has first been completed, and then the polishing material replacing step may be performed.

When a cylindrical film in which the above numerical value becomes less than 80% is formed, an annular body which has a desired surface state is not obtained.

The above respective steps will now be described below in detail.

[Method of Manufacturing Annular Body]

Polishing Material Charging Step

The polishing material is caused to collide with a specific region of the outer peripheral surface of a cylindrical film, thereby performing surface roughening, as described above. The polishing apparatus used for the surface roughening may be a dry blasting apparatus, a wet blasting (liquid honing) apparatus or the like for a method of causing the polishing material to collide.

Although the type of the polishing material to be used depends on the material of the cylindrical film, for example, polishing materials, such as alumina and silicon carbide, whose volume average particle diameter is from 10 μm to 100 μm (or from about 10 μm to about 100 μm), may be used. The volume average particle diameter may be measured by an electrical resistance test method (Coulter counter method).

The shape of the polishing material to be charged into the polishing apparatus, and the shape of the new polishing material to be charged in the polishing material replacing step which will be described below may be irregular shapes having edges as shown in FIGS. 3A to 3D. Here, the "irregular shape" means that the degree of circularity is 0.9 or less, and the degree of circularity may be 0.88 or less, or 0.85 or less.

The above degree of circularity is a ratio obtained by dividing the circumferential length of the corresponding circle by the circumferential length of a particle projection image, and the degree of circularity of a perfect circle becomes 1. As irregularities of particles are larger, the value of the degree of circularity becomes smaller. Measurement of the value is performed by imaging using a flow type particle image measuring machine (for example, FPIA-3000 made by Sysmex Corporation). Numerical values described in the present specification are measured by this method.

First Surface-Roughening Repeating Step

First, the cylindrical film is supported by a cylindrical support by arranging the cylindrical film on the outer peripheral surface of the support so as to be brought into close contact therewith. In a case where the cylindrical film is manufactured by the method of manufacturing a cylindrical film which will be described below, the cylindrical film formed on a mold surface which will be described below may be used as it is without being peeled off.

Figure 5:
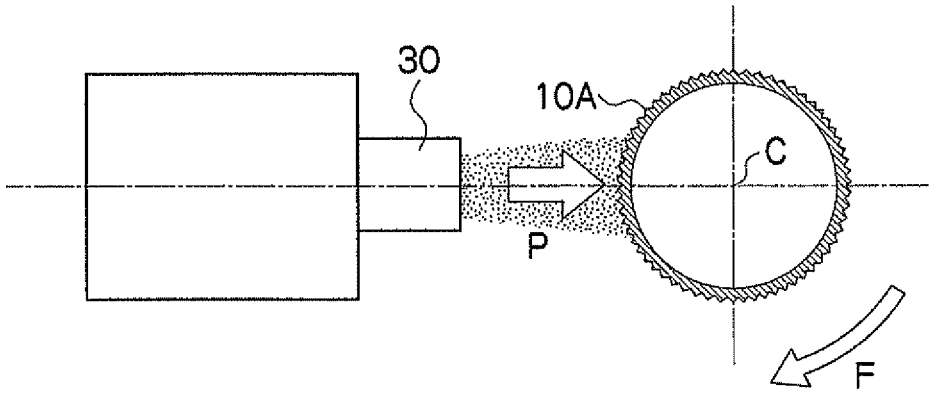
FIG. 5 is a schematic view showing an example of a method of roughening the outer peripheral surface of a resin layer to be used for the method of manufacturing an annular body according to an exemplary embodiment.

The cylindrical film supported by this support is set in the above polishing apparatus, and as shown in FIG. 5, the cylindrical film 10A is rotated in the circumferential direction (the direction of F in FIG. 5), and the polishing material is caused to collide with the cylindrical film 10A from a discharge nozzle 30 of the polishing apparatus. Particularly in the case of wet blasting (liquid honing) which causes the polishing material dispersed in water to collide with the cylindrical film, a method of blasting the polishing material together with water having a hydraulic pressure of from 0.2 MPa to 5.0 MPa, thereby performing surface roughening, may be used.

The surface roughness Ra of the cylindrical film 10A may be within a range of 0.2 μm or more but 1.5 μm or less, or within a range of 0.3 μm or more but 1.0 μm or less. Here, the surface roughness of the outer peripheral surface of the cylindrical film 10A is the value of an arithmetic mean roughness Ra measured pursuant to analytic standards: JIS B0601 (1994) by a surface roughness measuring machine (SURFCOM 1500DX made by Tokyo Seimitsu Co., Ltd.).

The method of causing the polishing material to collide with the cylindrical film is not limited to blasting. For example, a method of causing the polishing material to collide with the cylindrical film by the free fall of the polishing material may be adopted.

After the polishing material is caused to collide with the cylindrical film thereby performing surface roughening, the surface of the cylindrical film may be cleaned by blasting with water, and then draining may be performed.

After the surface-roughening operation is performed on one cylindrical film as described above, this cylindrical film on which the surface roughening has been completed is removed from the polishing apparatus, and a cylindrical film replacing operation of replacing the cylindrical film with another cylindrical film on which the surface roughening has not been completed is performed. In the first surface-roughening repeating step, the surface-roughening operation and the cylindrical film replacing operation are alternately and repeatedly performed.

Polishing Material Replacing Step

After the first surface-roughening repeating step, the polishing material is replaced by discharging a portion of the polishing material charged into the polishing apparatus, and charging a new polishing material so that the percentage of the new polishing material with respect to the total amount of the polishing material after the new polishing material is charged becomes 30% by weight or more.

As the timing when the polishing material replacing step is performed, as mentioned above, in the first surface-roughening repeating step, repetition of the surface-roughening operation and the cylindrical film replacing operation may be ended before forming a cylindrical film in which the ratio (surface area/projected area) of the surface area and projected area of the roughened surface in the cylindrical film becomes less than 80% with respect to the value of the ratio in the cylindrical film on which the surface roughening has first been completed, and then the polishing material replacing step may be performed.

Second Surface-Roughening Repeating Step

After the polishing material replacing step, the surface-roughening operation and the cylindrical film replacing operation described in the first surface-roughening repeating step are alternately and repeatedly performed again.

The polishing material replacing step and the surface-roughening repeating step may be further repeated after the second surface-roughening repeating step, i.e., a third surface-roughening repeating step or the following fourth, fifth, and further surface-roughening repeating steps may be performed.

As the timing when the polishing material replacing step in that case is performed, as mentioned above, in the last surface-roughening repeating step (for example, the second surface-roughening repeating step), repetition of the surface-roughening operation and the cylindrical film replacing operation may be ended before forming a cylindrical film in which the ratio (surface area/projected area) of the surface area and projected area of the roughened surface in the cylindrical film becomes less than 80% with respect to the value of the ratio in the cylindrical film on which the surface roughening has first been completed, and then the polishing material replacing step may be performed.

(Method of Manufacturing Cylindrical Film)

Next, a method of manufacturing the cylindrical film to be surface-roughened by the above method will be described.

(1) Coating Step

In the method of manufacturing the cylindrical film, first, a resin material is coated on the outer peripheral surface of a mold.

As the mold to be used, metals, such as aluminum, stainless steel, nickel, and copper, may be used. The length of the mold should be a length more than the intended width of the cylindrical film, the external diameter of the mold matches the intended diameter of the cylindrical film, and the thickness of the mold is set to a thickness such that the strength as the mold may be maintained.

As the mold, a cylindrical mold is used. In order to give mold releasability to the surface of the mold, there is a method of plating the mold surface with chromium or nickel, covering the mold surface with fluororesin or silicone resin, or coating a release agent to the surface.

Examples of the resin material (resin) include polyimide, polyamide imide, polycarbonate, polyester, polyamide, polyarylate, and the like. The concentration, viscosity, and the like of the resin material are freely selected.

For example, as polyimide precursors, various known precursors are used, such as a precursor consisting of 3,3',4,4'-biphenyl tetracarboxylic acid dianhydride (BPDA) and p-phenylenediamine (PDA), and a precursor consisting of BPDA and 4,4'-diamino diphenyl ether, and a precursor consisting of pyromellitic acid dianhydride (PMDA) and 4,4'-diamino diphenyl ether. Two or more kinds of polyimide precursors may be mixed and used, and a plurality of acid or amine monomers may be mixed and copolymerized.

Examples of solvents for the polyimide precursor include aprotic polar solvents, such as N-methylpyrrolidone, N,N-dimethylacetamide, and acetamide. The mixing ratio, concentration, viscosity, and the like of a polyimide precursor solution are freely selected.

As methods of coating the resin material to the outer peripheral surface of the mold, there are adopted known methods, such as a dip coating method of dipping the mold in the solution and pulling up the mold, a flow coating method which discharges the solution to the surface of the mold while rotating the mold, and a blade coating method of leveling a film with a blade at that time.

The "coating onto the mold" means that the outer peripheral surface of the mold is coated or in a case where the mold has a layer on its surface, the surface of the layer is coated. The "pulling up the mold" is based on the relative relation with the liquid level during coating, and includes a case where the mold is stopped and the coating liquid level is moved down.

In a case where coating is performed by the dip coating method, a method of controlling film thickness by the annular body may be applied as described in Japanese Patent Application Laid-Open (JP-A) No. 2002-91027.

Figure 6:
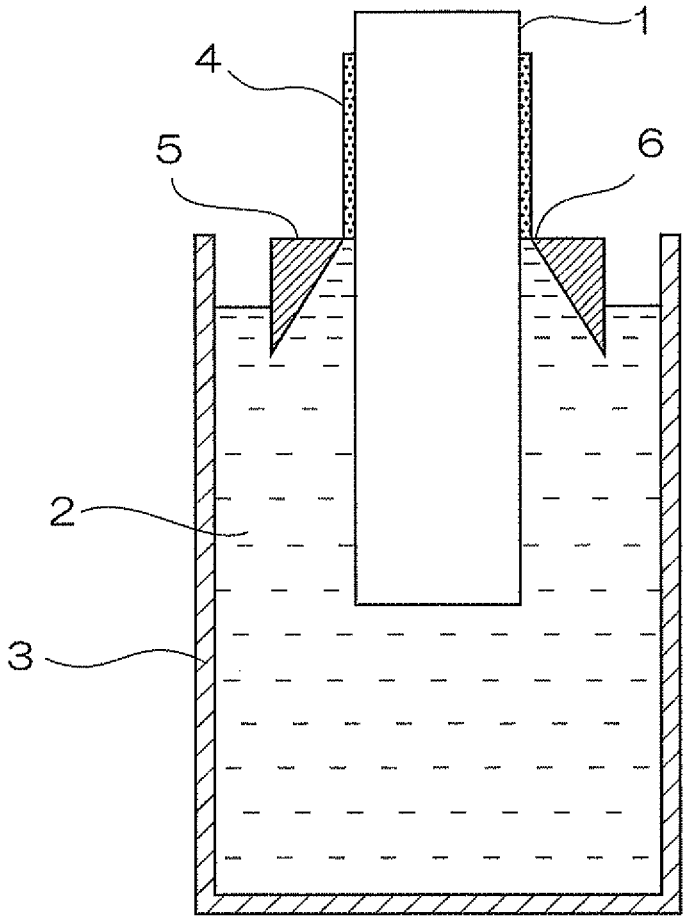
FIG. 6 is a schematic configuration diagram showing an example of an apparatus to be used for a dip coating method which controls film thickness by the annular body.

FIG. 6 is a schematic configuration diagram showing an example of an apparatus used for the dip coating method which controls film thickness by the annular body. Here, the drawing shows only principal sections, and a holding plate of the mold 1 and other apparatuses are omitted. This dip coating method, as shown in FIG. 6, is a method of floating the annular body 5 having a larger circular hole 6 than the external diameter of the mold 1 on a solution 2 put into a coating tank 3, and pulling up and coating the mold 1 through the circular hole 6.

The material of the annular body 5 is selected from metals, plastics, or the like into which a solvent of the solution 2 does not intrude. Since the film thickness of the coating film 4 is regulated by the gap between the external diameter of the mold 1 and the internal diameter of the circular hole 6, the internal diameter of the circular hole 6 is adjusted depending on a desired film thickness.

The mold 1 is pulled up through the circular hole 6 during coating. The pull-up speed may be from 0.1 to 1.5 m/min. The viscosity of a solution for this coating method may be from 1 Pa·s to 100 Pa·s.

Figure 7A:
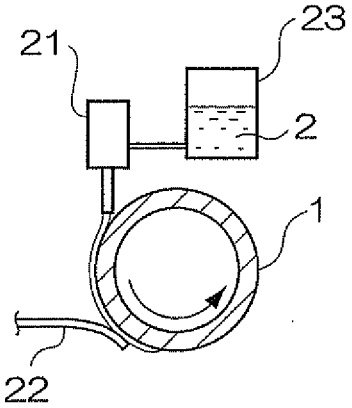
FIGS. 7A and 7B are schematic views showing a coating method by a rotary coating apparatus.
Figure 7B:
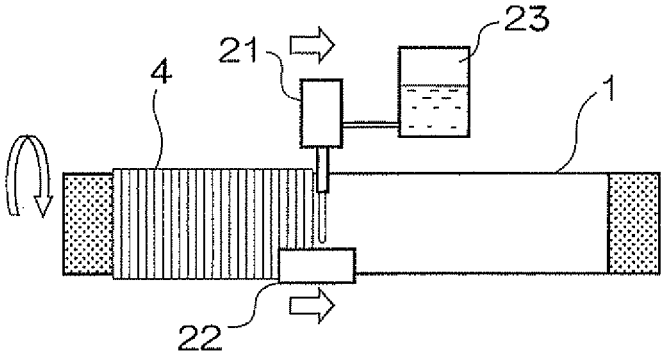

As shown in FIGS. 7A and 7B, coating may be performed by a rotary coating apparatus, using the above solution 2. In the rotary coating apparatus, a mono pump 21 is connected to a container 23 into which the resin material (solution 2) is put, thereby adjusting the amount of discharge, and a blade 22 including a stainless steel plate or the like is attached directly below a discharged liquid. The mold 1 is rotated while moving a discharge section and the blade from the left to the right on the drawing, thereby coating the solution 2 on the outer peripheral surface of the mold 1.

(2) Curing Step

In the curing step, the coating film formed on the mold 1 is heated and dried. That is, heating and drying is performed to such a degree that the coating film does not deform when left to stand in order to remove the solvent which is present in the coating film. Although heating and drying conditions depend on the kind of resin or solvent, heating and drying may be performed for from 30 minutes to 60 minutes at a temperature from 80° C. to 170° C. The heating time may be shorter as the temperature is higher. The temperature may be raised stepwise or at a constant rate within a certain time. It is also effective to apply a hot air during heating.

In a case where sagging occurs on the coating film during heating and drying, it is effective to make the axial direction of the mold 1 horizontal and to rotate the mold slowly. The rotating speed may be from 1 rpm to 60 rpm.

In a case where higher-temperature drying is required, heating is performed (heating reaction treatment). For example, in a case of polyimide resin, a polyimide resin film may be formed by heating the coating film at from 300° C. to 350° C., or at from 250° C. to 450° C., for from 20 minutes to 60 minutes, thereby causing a condensation reaction. In that case, the residual solvent may be completely removed before the final temperature of heating is reached. Specifically, heating may be performed for from 10 minutes to 30 minutes at a temperature from 200° C. to 250° C. to dry the residual solvent, and subsequently the temperature may be raised stepwise or at a constant rate.

The cylindrical film is formed on the outer peripheral surface of the mold in this way, and then, surface roughening is performed on this cylindrical film in the aforementioned first surface-roughening repeating step, the second surface-roughening repeating step, or the like.

[Endless Belt for Electromagnetic Induction Heating System]

Next, an endless belt in which a metal layer is formed on the annular body (resin layer) obtained by the manufacturing method according to the exemplary embodiment will be described with reference to the drawings.

Figure 8:
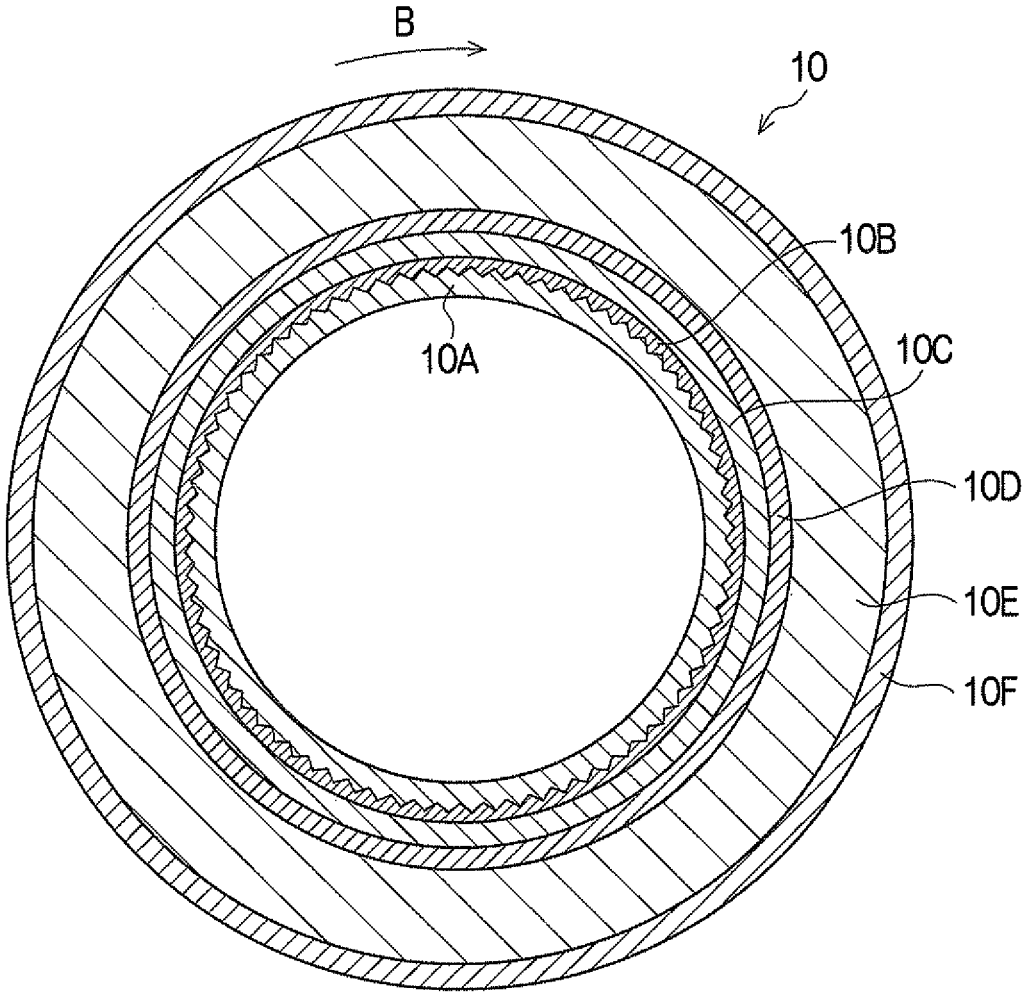
FIG. 8 is a schematic view showing a section in the circumferential direction of an endless belt in which a metal layer is formed on the annular body (resin layer) obtained by the manufacturing method according to an exemplary embodiment.
Figure 9:
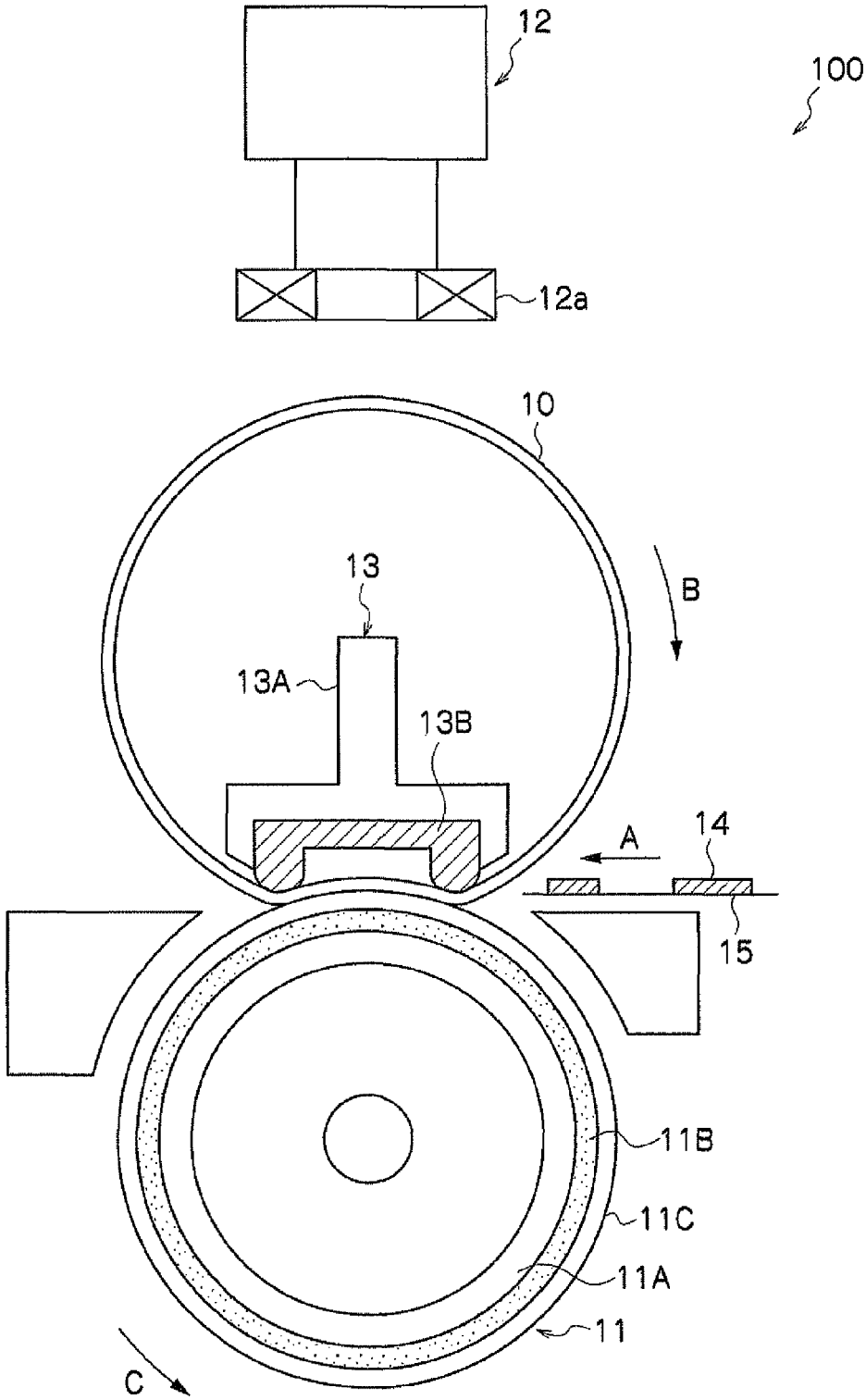
FIG. 9 is a schematic view showing the configuration of an electromagnetic induction heating type fixing device including the endless belt shown in FIG. 8 as a fixing belt.

FIG. 8 shows schematically a cross-sectional configuration in the circumferential direction of an endless belt in which a metal layer is formed on the annular body (resin layer) obtained by the manufacturing method according to the exemplary embodiment, and FIG. 9 shows schematically the configuration of an electromagnetic induction heating type fixing device (hereinafter also referred to as an "electromagnetic induction heating fixing device" or "fixing device") including the above endless belt as a fixing belt.

In the endless belt 10 (hereinafter also referred to as a "fixing belt" or "belt"), the annular body (resin layer) 10A which is a base material, a foundation metal layer (metal anchor layer) 10B, a metal heat-generation layer 10C, a metal protective layer 10D, an elastic layer 10E, and the releasing layer 10F are laminated in this order from the inner peripheral surface side toward the outer peripheral surface side.

(Annular Body (Resin Layer))

The annular body 10A, which is a base material of the fixing belt 10, is repeatedly conveyed (rotated) at a fixing temperature in the circumferential direction of the belt 10 within the electromagnetic induction heating fixing device 100, while the metal heat-generation layer 10C provided adjacent to the annular body 10A generates heat. As this annular body, an annular body obtained by the manufacturing method according to the exemplary embodiment is used as already stated.

The thickness of the annular body 10A may be in a range from 10 μm to 200 μm. The thickness of the annular body 10A is a value measured by an eddy current type thickness meter (made by Fischer Instruments Ltd.).

(Foundation Metal Layer)

The foundation metal layer 10B is, for example, a layer provided in order to form the metal heat-generation layer 10C on the outer peripheral surface of the annular body 10A made of resin, and is formed if needed. A method of forming the metal heat-generation layer 10C may be an electrolytic plating method, but it is difficult to perform electrolytic plating directly on the annular body 10A made of resin. Thus, the foundation metal layer 10B is required in order to form the metal heat-generation layer 10C. As a method of forming this foundation metal layer 10B, chemical plating may be used. Particularly, general chemical nickel plating may be used.

The thickness of the foundation metal layer 10B may be a thickness at which the flexibility of the belt 10 is not impaired, and may be within a range of, for example, from 0.1 μm to 10 μm.

(Metal Heat-Generation Layer)

The metal heat-generation layer 10C is a layer which has the function to generate an eddy current by a magnetic field generated from a coil, thereby generating heat, in the electromagnetic induction heating fixing device 100, and is made of a metal which causes an electromagnetic induction action.

The metal which causes an electromagnetic induction action is selected from single metals, such as nickel, iron, copper, gold, silver, aluminum, chromium, tin, and zinc, or alloys (steel or the like) consisting of two or more kinds of elements. Among them, copper, nickel, aluminum, iron, and chromium may be used, or copper or an alloy consisting mainly of copper may be used.

Although a suitable thickness is different depending on the material of the metal heat-generation layer 10C, the thickness of the metal heat-generation layer may be within a range from 3 μm to 50 μm, for example, in a case where copper is used for the metal heat-generation layer 10C.

(Metal Protective Layer)

The metal protective layer 10D is a layer which is provided on the heat-generation layer 10C to protect the heat-generation layer. Particularly, in a case where the metal heat-generation layer 10C consisting mainly of copper is used, the metal protective layer 10D may be provided on the heat-generation layer 10C.

The metal protective layer 10D may be a thin film made of an oxidation-resistant metal having high durability and oxidation resistance. A method of forming the metal protective layer 10D may be an electrolytic plating method when workability in a thin film is taken into consideration. Especially, electrolytic nickel plating, through which metal film with high strength is obtained, may be used.

Although a suitable thickness is different according to the material of the metal protective layer 10D, the thickness of the metal protective layer may be within a range from 2 to 20 for example, in a case where nickel is used for the metal protective layer 10D. The thicknesses of the metal heat-generation layer 10C and the metal protective layer 10D are values measured by a fluorescent X-ray thickness meter (made by Fischer Instruments Ltd.).

Although the fixing belt 10 shown in FIG. 8 has a three-layer metal layer (the foundation metal layer 10B, the metal heat-generation layer 10C, and the metal protective layer 10D) on the outer peripheral surface of the annular body 10A, the fixing belt is not limited thereto, and the metal layer may be a single layer, may be two layers, or may be four or more layers. For example, the foundation metal layer 1013 may not be provided, and the metal heat-generation layer 10C may be directly provided on the outer peripheral surface of the annular body 10A by a sputtering method or the like.

(Elastic Layer)

The elastic layer 10E is a layer which plays the role of bringing the surface of the fixing belt 10 into close contact with a toner image by following irregularities of the toner image on the recording medium.

The elastic layer 10E is a layer made of a material capable of being restored to its original shape even when deformed by the application of an external force of 100 Pa. A material which constitutes the elastic layer 10E may be a known elastic material. For example, a heat-resistant rubber, such as silicone rubber and fluororubber, may be used. Specifically, examples thereof include a liquid silicone rubber SE 6744 made by Dow Corning Toray Silicone Co., Ltd., and Viton B-202 made by DuPont Dow Elastomers LLC.

(Releasing Layer)

The releasing layer 10F is formed in order to prevent a toner in a molten state from firmly adhering to the fixing belt 10 when an unfixed toner image is fixed on a recording medium in a molten state by using the fixing belt (endless belt) 10. The releasing layer 10F may be provided if needed.

The releasing layer 10F may be formed using a fluorinated compound as a main component. Examples of the fluorinated compound include, for example, fluororesins, such as fluororubber, polytetrafluoroethylene (PTFE), a perfluoroalkyl vinyl ether copolymer (PFA), and tetrafluoroethylene hexafluoropropylene copolymer (FEP), and the like.

The thickness of the releasing layer 10F is, for example, from 10 μm to 100 μm.

[Fixing Device]

Next, the electromagnetic induction type fixing device 100 with the above endless belt 10 as a fixing belt will be described.

As shown in FIG. 9, the pressure roller (pressure member) 11 is arranged so as to press a portion of the fixing belt 10, and a contact region is formed between the fixing belt 10 and the pressure roller 11. In this contact region, the fixing belt 10 curves in the shape along the circumferential surface of the pressure roller 11.

In the pressure roller 11, an elastic body layer 11B made of silicone rubber or the like is formed on a base material 11A, and a releasing layer 11C made of a fluorinated compound is formed on the elastic body layer 11B.

Inside the fixing belt 10, the pressure member 13 is arranged at a position which faces the pressure roller 11. The pressure member 13 has a pad 13B made of a metal, heat-resistant resin, heat-resistant rubber, or the like, which is in contact with the inner peripheral surface of the fixing belt 10 and increases a local pressure, and a support 13A which supports the pad 13B.

An electromagnetic induction heating device 12 having an electromagnetic induction coil (exciting coil) 12*a* built therein is provided at a position which faces the pressure roller 11 via the fixing belt 10. The electromagnetic induction heating device 12 applies an alternating current to the electromagnetic induction coil, changes the generated magnetic field using an excitation circuit, and makes the metal heat-generation layer 10C of the fixing belt 10 generate an eddy current. This eddy current is converted into heat (Joule heat) by the electric resistance of the metal heat-generation layer 10C, and consequently the surface of the fixing belt 10 generates heat. The position of the electromagnetic induction heating device 12 is not limited to the position shown in FIG. 9. For example, the electromagnetic induction heating device may be installed at the upstream side of the contact region of the fixing belt 10 in a rotational direction B, or may be installed inside the fixing belt 10.

In the electromagnetic induction heating type fixing device 100 shown in FIG. 9, when a driving force is transmitted by a drive device (not shown) to gears arranged at both ends of the fixing belt 10, the fixing belt 10 self-rotates in the direction of an arrow B, and the pressure roller 11 rotates in an opposite direction, i.e., in the direction of an arrow C, along with the rotation of the fixing belt 10.

A recording material 15 on which an unfixed toner image 14 is formed is allowed to pass through the contact region between the fixing belt 10 and the pressure roller 11 in the fixing device 100 in the direction of the arrow A, and the unfixed toner image 14 is fixed in a molten state on the recording material 15 with pressure.

<Image Forming Apparatus>

Figure 10:
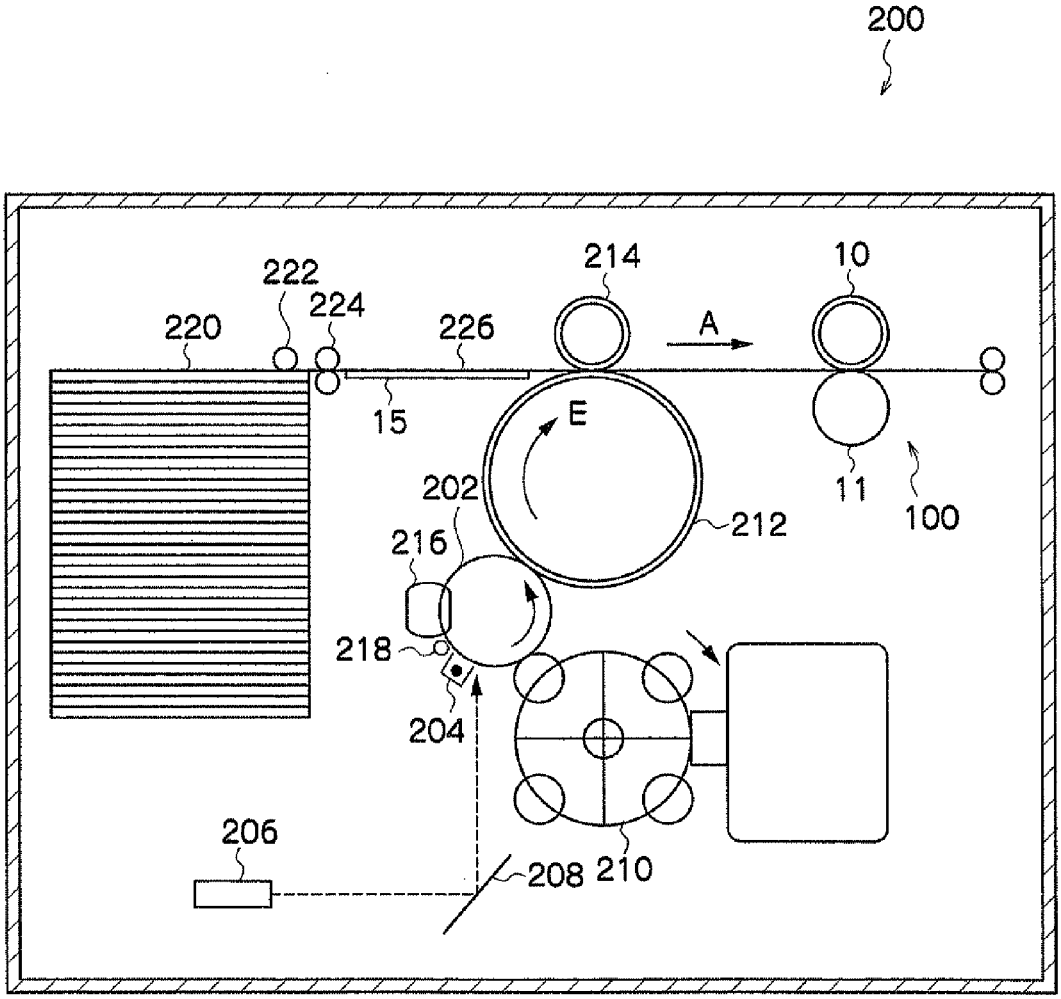
FIG. 10 is a schematic view showing the configuration of an image forming apparatus including the fixing device shown in FIG. 9.

FIG. 10 schematically shows the configuration of an image forming apparatus including the fixing device shown in FIG. 9.

An image forming apparatus 200 includes a photoreceptor drum (image carrier) 202, a charging device (charging unit) 204, a laser scanner (electrostatic latent image forming unit) 206, a mirror 208, a developing device (developing unit) 210, an intermediate transfer body 212, a transfer roller (transfer unit) 214, a cleaning device 216, an eraser 218, a fixing device (fixing unit) 100, a sheet feeder (a sheet feed unit 220, a sheet feed roller 222, a registration roller 224, and a recording medium guide 226).

In a case where image formation is performed in this image forming apparatus 200, first, a noncontact charging device 204 provided in proximity to the photoreceptor drum 202 charges the surface of the photoreceptor drum 202.

The surface of the photoreceptor drum 202 charged by the charging device 204 is irradiated with the laser light according to image information (signal) on each color from a laser scanner 206 via a mirror 208, thereby forming an electrostatic latent image.

The developing device 210 forms a toner image by giving a toner to the latent image formed on the surface of the photoreceptor drum 202. The developing device 210 includes developing units (not shown) for respective colors which contain four-color toners of black, cyan, magenta, and yellow, respectively. As the developing device 210 rotates in the direction of an arrow, each color toner is given to the latent image formed on the surface of the photoreceptor drum 202, thereby forming a toner image.

The color toner images formed on the surface of the photoreceptor drum 202 are overlappingly transferred to the outer peripheral surface of the intermediate transfer body 212 so as to coincide with image information for the respective color toner images in a contact portion between the photoreceptor drum 202 and the intermediate transfer body 212 by a bias voltage applied between the photoreceptor drum 202 and the intermediate transfer body 212.

The intermediate transfer body 212 rotates in the direction of an arrow E while its outer peripheral surface is in contact with the surface of the photoreceptor drum 202.

In addition to the photoreceptor drum 202, a transfer roller 214 is provided around the intermediate transfer body 212.

The intermediate transfer body 212 on which each color toner image has been transferred rotates in the direction of the arrow E. The toner image on the intermediate transfer body 212 is transferred to the surface of the recording medium 15 conveyed to the contact portion in the direction of the arrow A by the sheet feeder, in the contact portion between the transfer roller 214 and the intermediate transfer body 212.

Feeding of a sheet to the contact portion between the intermediate transfer body 212 and the transfer roller 214 is performed such that a recording medium stored in the sheet feed unit 220 is pushed up to a position where the recording medium comes into contact with the sheet feed roller 222 by a recording medium push-up unit (not shown) which is built in the sheet feed unit 220, the sheet feed roller 222 and the registration roller 224 rotate, and the recording medium is thereby conveyed in the direction of the arrow A along the recording medium guide 226.

The toner image transferred to the surface of the recording medium 15 moves in the direction of the arrow A. In the contact region between the fixing belt 10 and the pressure roller 11, the toner image 14 is pressed in a molten state against the surface of the recording medium 15, and is fixed on the surface of the recording medium 15. Thereby, an image fixed on the surface of the recording medium is formed.

The surface of the photoreceptor drum 202 after a toner image is transferred to the surface of the intermediate transfer body 212 is cleaned by the cleaning device 216.

After the surface of the photoreceptor drum 202 is cleaned by the cleaning device 216, the surface is discharged by the eraser 218.

EXAMPLES

The invention will now be more specifically described below by way of examples. Here, the invention is not limited to the following examples.

Method of Manufacturing Electromagnetic Induction Heating Type Fixing Belt

In the Examples and Comparative Examples which are shown below, the fixing belt is prepared according to the following steps.

Cylindrical Film Forming Step

First, a cylindrical mold (external diameter: 30 mm, and length: 600 mm) surface treated with a release agent (KS700 made by Toray Industries, Inc.) is coated with a polyimide precursor solution (U-varnish S made by Ube Industries, Ltd.), using a flow coating apparatus. After drying for 30 minutes at 100° C., the mold is put into a furnace at 380° C. and baked for 60 minutes, and a cylindrical film (resin layer: 60 μm thickness) is formed.

Surface-Roughening Operation

Next, as a foundation treatment, surface roughening is performed to obtain an annular body of the resin layer by blasting an irregular alumina polishing material (WA320J (trade name) made by Showa Denko K.K., particle diameter (D-50%): 40±2.5 μm) against the surface of the resin layer using a liquid honing apparatus while the mold is rotated so that the surface roughness of the resin layer becomes Ra 0.7 μm.

Respective Metal Layer Forming Step

An electroless nickel film is formed with a thickness of 0.6 μm as a foundation metal layer on the surface of the surface-roughened annular body (resin layer). In order to perform electrolytic plating with this foundation metal layer as a cathode, power feeding portions are arranged at both ends of the belt outside the width of plain paper in the axial direction of the belt.

Next, an electrolytic copper plating film (10 μm in thickness) serving as the heat-generation layer, and an electrolytic nickel plating film (10 μm in thickness) as the protective layer are sequentially formed.

Elastic Layer and Releasing Layer Forming Step

Thereafter, a flow coating apparatus is used to perform coating and drying of a foundation treatment primer (DY39-111 A/B made by Dow Corning Toray Silicone, Inc.) and liquid silicone rubber (X34-1053 A/B made by Shin-Etsu Chemical Co., Ltd.). Next, an elastic layer (200 μm in thickness) is formed by putting the mold into a furnace at 200° C. to perform curing and baking.

Moreover, a foundation treatment primer (No. 101 A/B made by Shin-Etsu Chemical Co., Ltd.) for a releasing layer is coated, and dried for 30 minutes at 100° C. Thereafter, a releasing layer is formed by covering with a tube (30 μm in thickness) of PFA (tetrafluoroethylene perfluoroalkyl vinyl ether copolymer) which becomes a releasing layer using a tube covering machine, and is put into a furnace at 200° C., thereby performing curing and baking, whereby an electromagnetic induction heating type fixing belt is obtained.

Example 1

In Example 1, a total of 3600 fixing belts are prepared, and at that time, the surface-roughening operation is performed as follows.

First, 40 kg of a polishing material and water are put into a tank of the liquid honing apparatus, and a mixed liquid is made. In this case, the concentration of the polishing material is 27% (volume basis). When a new polishing material just put into the tank of the liquid honing apparatus is observed with a microscope, as shown in FIGS. 3A to 3D, the polishing material with an irregular shape having an acute angle is observed, and the degree of circularity is 0.871.

The cylindrical film (resin layer) formed on the mold in the cylindrical film forming step is set in this liquid honing apparatus. While the mold is rotated, a polishing material is blasted with a hydraulic pressure of 0.31 MPa against the surface of the cylindrical film for 1.5 minutes with moving down at a constant speed, thereby performing surface roughening of the cylindrical film, and this operation is repeated for 600 cylindrical films (first surface-roughening repeating step).

Thereafter, 11 kg of the polishing material within the tank of the liquid honing apparatus is discharged, 12 kg of a new polishing material is charged into the tank, and it is confirmed that the concentration (volume basis) has become 27%. The polishing material replaced at this time is 30% of a total amount (polishing material replacing step). When the polishing material discharged from the tank of the liquid honing apparatus is observed with a microscope, as shown in FIGS. 4A to 4D, there is almost no polishing material having an acute angle, and the degree of circularity is 0.930.

After a polishing liquid is stirred, surface roughening is performed for additional 600 cylindrical films (a total of 1200) under the same conditions as the first surface-roughening repeating step (second surface-roughening repeating step).

After that, each time surface roughening for 600 cylindrical films is completed, a portion of the polishing material is discharged from the tank of the apparatus and a new polishing material is charged into the tank, so that the concentration (volume basis) become 27%, and 30% of the polishing material is replaced in a total amount of the polishing material. By repeating this procedure, the surface roughening is continued for a total of 3600 cylindrical films.

Among the belts surface-roughened by the above method, the results obtained by measuring the surfaces of the $1^{st}$, $600^{th}$, $601^{st}$, $1200^{th}$, $1201^{st}$, $1800^{th}$, $1801^{st}$, $2400^{th}$, $2401^{st}$, $3000^{th}$, $3001^{st}$, and $3600^{th}$ surface-roughened belts by a laser microscope (VK9500 made by KEYENCE CORPORATION), and calculating the ratio (surface area/projected area) of the surface area and projected area, and the percentage of the ratio with respect to the ratio of the first belt are shown in Table 1. There is no belt in which the ratio (surface area/projected area) of the surface area and projected area falls below 3.15.

Figure 11A:
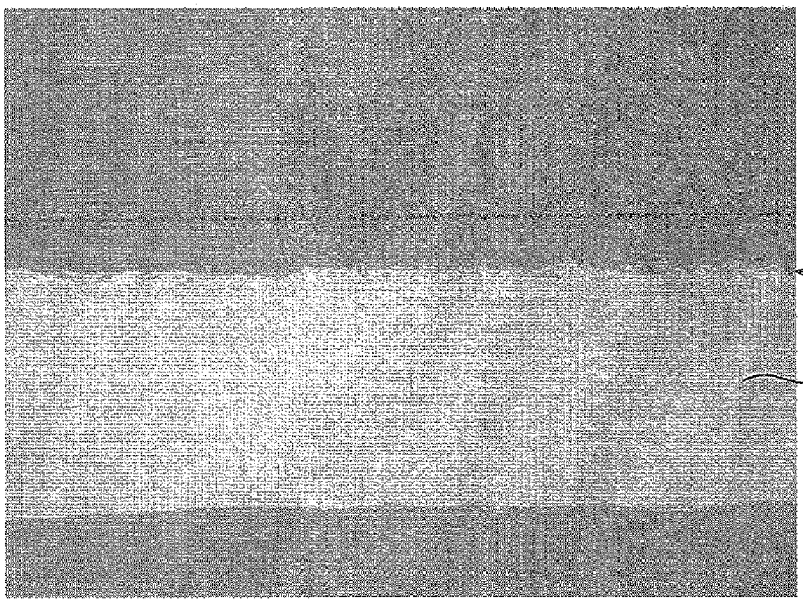
FIG. 11A is a cross-sectional photograph when the roughened surface of the 1800th manufactured annular body in Comparative Example 1 is observed with a microscope.
Figure 11B:
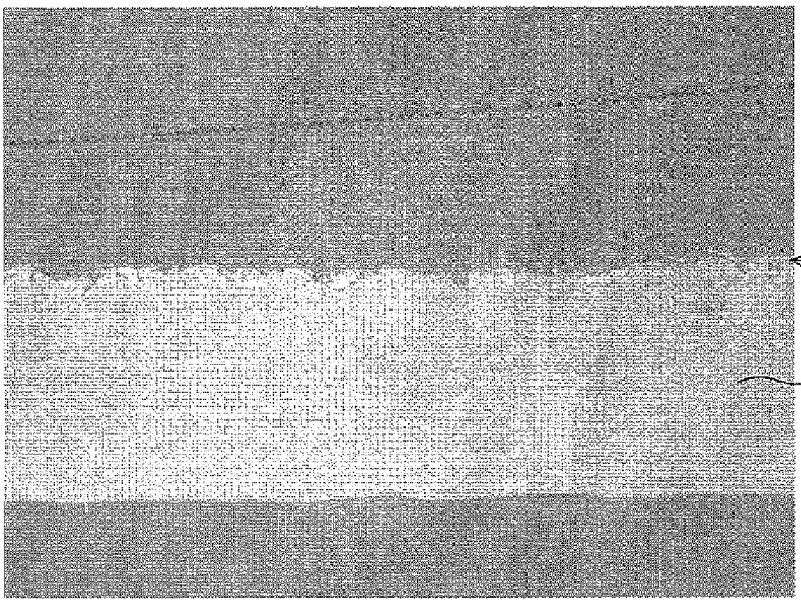
FIG. 11B is a cross-sectional photograph when the roughened surface of the 1800th manufactured annular body in Example 1 is observed with a microscope.

When the roughened surface of the $1800^{th}$ belt is observed with a microscope, as shown in the cross-sectional photograph of FIG. 11B, the roughened surface is a rough surface with irregularities having an acute angle. Even when the roughened surface of the $2400^{th}$ belt is observed with a microscope, the roughened surface is a rough surface with irregularities having an acute angle.

Thereafter, an electroless nickel film serving as the foundation metal layer, an electrolysis copper plating film serving as the heat-generation layer and an electrolysis nickel plating film serving as the protective layer are sequentially formed on the roughened surface of the cylindrical film (resin layer) as shown in the respective metal layer forming steps, and the adhesion force between the cylindrical film (resin layer) and the metal layer is measured by the following methods.

Adhesion Force (90° Peeling Test)

Annular test samples sliced to have a width of 20 mm are prepared from three arbitrary positions in the axial direction of the above cylindrical film on which the respective metal layers have been formed, a portion of each of the respective test samples is bent and peeled between the cylindrical film (resin layer) and the metal layer, giving a pulling margin, and are set on a 90° peeling test machine (Model-1301D made by AIKO ENGINEERING CO., LTD.). Peeling is performed between the cylindrical film (resin layer) and the metal layer at a speed of 50 mm/min, and measurement is performed. An average value within an effective range (range which contributes to formation of an image) when being used as a fixing belt is calculated, and the average value of the three arbitrary positions in the axial direction is calculated and regarded as an adhesion force.

The measurement results are shown in Table 1. There is no belt having an adhesion force that falls below 0.20 N/mm.

Comparative Example 1

In Comparative Example 1, a total of 2400 fixing belts are prepared, and at that time, the surface-roughening operation is performed as follows.

First, 40 kg of a polishing material and water are put into the tank of the liquid honing apparatus, and a mixed liquid is made. In this case, the concentration of the polishing material is 27% (volume basis). When a new polishing material just put into the tank of the liquid honing apparatus is observed with a microscope, as shown in FIGS. 3A to 3D, the polishing material with an irregular shape having an acute angle is observed.

The cylindrical film (resin layer) formed on the mold in the cylindrical film forming step is set in this liquid honing apparatus. While the mold is rotated, a polishing material is blasted against the surface of the cylindrical film under the same conditions as Example 1, thereby performing surface roughening of the cylindrical film, and this operation is performed similarly to Example 1 until the operation is repeated for 600 cylindrical films (first surface-roughening repeating step).

Thereafter, the polishing material is not discharged from the tank of the liquid honing apparatus, and a new polishing material is charged so that the concentration (volume basis) become 27%. As a result, the amount of charged new polishing material is 5 kg, and the percentage of the new polishing material with respect to the total amount of the polishing material after the charging is 12.5% by weight (polishing material adding step).

After a polishing liquid is stirred, surface roughening is performed for additional 600 cylindrical films (a total of 1200) under the same conditions as the first surface-roughening repeating step (second surface-roughening repeating step).

After that, each time surface roughening for 600 cylindrical films is completed, the polishing material is not discharged from the tank of the apparatus, a new polishing material is charged into the tank so that the concentration (volume basis) becomes 27%. By repeating this procedure, the surface roughening is continued for a total of 2400 cylindrical films.

Among the belts surface-roughened by the above method, the results obtained by measuring the surfaces of the $1^{st}$, $600^{th}$, $601^{st}$, $1200^{th}$, $1201^{st}$, $1800^{th}$, $1801^{st}$, and $2400^{th}$ surface-roughened belts by a laser microscope (VK9500 made by KEYENCE CORPORATION), and calculating the ratio (surface area/projected area) of the surface area and projected area, and the percentage of the ratio with respect to the ratio of the first belt are shown in Table 1. The ratio (surface area/projected area) of the surface area and projected area fell below 3.00 in the $1800^{th}$ belt and the $2400^{th}$ belt.

When the roughened surface of the 1800$^{th}$ belt is observed with a microscope, as shown in the cross-sectional photograph of FIG. 11A, almost no irregularities having an acute angle are seen. When the roughened surface of the 2400$^{th}$ belt is observed with a microscope, almost no irregularities having an acute angle are seen.

Thereafter, an electroless nickel film serving as the foundation metal layer, an electrolytic copper plating film serving as the heat-generation layer and an electrolytic nickel plating film serving as the protective layer are sequentially formed on the roughened surface of the cylindrical film (resin layer) as shown in the respective metal layer forming steps. The results of the adhesion force between the cylindrical film (resin layer) and the metal layer obtained by the measurement methods described in Example 1 are shown in Table 1. The adhesion force is 0.185 N/mm in the 1800$^{th}$ belt, and the adhesion force is 165 N/mm in the 2400$^{th}$ belt, both of which exhibit a great decrease.

TABLE 1

| Number of roughened belts | Replacement of polishing material | Surface area/Projected area | | Percentage with respect to first belt [%] | | Adhesion force [N/mm] | |
|---|---|---|---|---|---|---|---|
| | | Example 1 | Comparative Example 1 | Example 1 | Comparative Example 1 | Example 1 | Comparative example 1 |
| 1 | Immediately after charging | 3.77 | 3.72 | — | — | 0.311 | 0.303 |
| 600 | Immediately before replacement | 3.33 | 3.31 | 88.3% | 89.0% | 0.234 | 0.230 |
| 601 | Immediately after replacement | 3.56 | 3.40 | 94.4% | 91.4% | 0.294 | 0.245 |
| 1200 | Immediately before replacement | 3.26 | 3.05 | 86.5% | 82.0% | 0.244 | 0.213 |
| 1201 | Immediately after replacement | 3.41 | 3.12 | 90.5% | 83.9% | 0.298 | 0.231 |
| 1800 | Immediately before replacement | 3.19 | 2.95 | 84.6% | 79.3% | 0.239 | 0.185 |
| 1801 | Immediately after replacement | 3.43 | 3.10 | 91.0% | 83.3% | 0.283 | 0.203 |
| 2400 | Immediately before replacement | 3.16 | 2.90 | 83.8% | 78.0% | 0.244 | 0.165 |
| 2401 | Immediately after replacement | 3.39 | (Not Performed) | 89.8% | (Not Performed) | 0.278 | (Not Performed) |
| 3000 | Immediately before replacement | 3.17 | (Not Performed) | 84.1% | (Not Performed) | 0.239 | (Not Performed) |
| 3001 | Immediately after replacement | 3.38 | (Not Performed) | 89.7% | (Not Performed) | 0.269 | (Not Performed) |
| 3600 | Immediately before replacement | 3.16 | (Not Performed) | 83.8% | (Not Performed) | 0.228 | (Not Performed) |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method of manufacturing an annular body, comprising:

(A) charging a polishing material into a polishing apparatus that polishes a surface of a cylindrical film comprising a resin;

(B) alternately and repeatedly performing a surface-roughening operation of causing the polishing material to collide with the surface of the cylindrical film, thereby roughening the surface, and a cylindrical film replacing operation of replacing the cylindrical film on which roughening of the surface has been completed with another cylindrical film on which roughening of the surface has not been completed;

(C) replacing the polishing material by discharging a portion of the polishing material charged into the polishing apparatus after the (B) alternately and repeatedly performing the surface-roughening operation and the cylindrical film replacing operation, and charging a new polishing material so that the percentage of the new polishing material with respect to the total amount of the polishing material after the new polishing material is charged becomes about 30% by weight or more; and (D) alternately and repeatedly performing the surface-roughening operation and the cylindrical film replacing operation again after the (C) replacing the polishing material, wherein, in the (B) alternately and repeatedly performing the surface-roughening operation and the cylindrical film replacing operation, repetition of the surface-roughening operation and the cylindrical film replacing operation is ended before forming a cylindrical film in which a ratio (surface area/projected area) of the surface area and projected area of the roughened surface in the cylindrical film becomes less than about 80% with respect to the value of a ratio surface area/projected area in the cylindrical film on which the surface roughening has first been completed, and then the (C) replacing the polishing material is performed.

2. The method of manufacturing an annular body according to claim 1, wherein the resin is a resin selected from the group consisting of a polyimide, a polyamide imide, a polycarbonate, a polyester, a polyamide, and a polyarylate.

3. The method of manufacturing an annular body according to claim 1, wherein the resin is a polyimide.

4. The method of manufacturing an annular body according to claim 1, wherein the polishing apparatus is a dry blasting apparatus or a wet blasting apparatus.

5. The method of manufacturing an annular body according to claim 1, wherein the polishing apparatus is a wet blasting apparatus.

6. The method of manufacturing an annular body according to claim 1, wherein the polishing material is an alumina or silicon carbide polishing material having a volume average particle diameter of from about 10 μm to about 100 μm.

7. The method of manufacturing an annular body according to claim 1, wherein the polishing material is an alumina polishing material having a volume average particle diameter of from about 10 μm to about 100 μm.

* * * * *